US008089019B2

(12) United States Patent
Inagaki et al.

(10) Patent No.: US 8,089,019 B2
(45) Date of Patent: Jan. 3, 2012

(54) TRIGGER SWITCH

(75) Inventors: Isao Inagaki, Kanagawa (JP); Junichi Nishikimi, Aichi (JP); Akira Tomonaga, Aichi (JP)

(73) Assignees: Satori S-Tech Co., Ltd., Tokyo (JP); Makita Corporation, Aichi (JP)

( * ) Notice: Subject to any disclaimer, the term of this patent is extended or adjusted under 35 U.S.C. 154(b) by 245 days.

(21) Appl. No.: 12/636,882

(22) Filed: Dec. 14, 2009

(65) Prior Publication Data

US 2010/0187085 A1 Jul. 29, 2010

(30) Foreign Application Priority Data

Jan. 28, 2009 (JP) ..... 2009-016541

(51) Int. Cl.
*H01H 13/02* (2006.01)

(52) U.S. Cl. ..... 200/522

(58) Field of Classification Search ..... 200/522, 200/43.16, 43.17, 520, 529, 533, 534, 332.1, 200/332.2, 329, 61.85, 6 R, 333, 302.1–302.3
See application file for complete search history.

(56) References Cited

U.S. PATENT DOCUMENTS 4,241,297 A * 12/1980 Piber et al. ..... 318/17
4,568,807 A * 2/1986 Piber ..... 200/302.2
7,297,891 B2 * 11/2007 Omori et al. ..... 200/522
7,557,321 B2 * 7/2009 Arataki et al. ..... 200/522

FOREIGN PATENT DOCUMENTS

JP 2009-54540 3/2009

* cited by examiner

*Primary Examiner* — Edwin A. Leon
(74) *Attorney, Agent, or Firm* — Wenderoth, Lind & Ponack, L.L.P.

(57) ABSTRACT

In a trigger switch having a normal and reverse switching lever configured to switch the direction of rotation of a motor, a case is formed with a speed control unit storage chamber for storing a speed control unit, a revolving shaft storage chamber for storing a revolving shaft of the switching lever and a contact strip member storage chamber with continuing from the revolving shaft storage chamber through a shielding member therebetween for storing contact strip member of the switching lever, the revolving shaft storage chamber is formed with a revolving shaft engaging hole configured to allow the revolving shaft to be inserted in an engaged state on an upper portion thereof on the side of the trigger lever, and a waterproof device for covering at least a gap between the switching lever and the revolving shaft engaging hole is provided to prevent entry of water therein.

8 Claims, 8 Drawing Sheets

TRIGGER SWITCH

BACKGROUND OF THE INVENTION

1. Field of the Invention

The present invention relates to a trigger switch having a normal and reverse switching lever used in a brushless motor-mounted power tool or the like and, more specifically, to a trigger switch having waterproof, leak-proof, and corrosion-proof structures.

2. Prior Art

A "trigger switch" described in JP-A-2009-054540 for example is known as a trigger switch having a normal and reverse switching lever in the prior art. As shown in FIGS. 12, 13, and 14, the trigger switch has a configuration including a sliding operation unit 15 having a sliding contact point mechanism integrated in the interior of a main body formed into a box shape, and configured to transmit a sliding operation from an external trigger lever 11, and also including a case 12 opening on a side surface, a cover 14 configured to close an opening surface on the side surface of the case 12 and provided with a sliding circuit board 13 mounted on an inner side surface thereof, the trigger lever 11 which allows operation by a finger, and a switching operation unit 25 provided at an upper position of the case 12 and configured to switch the direction of rotation of a motor between a normal rotation and a reverse rotation.

The switching operation unit 25 includes a switching lever 26 stored in a switching lever storage chamber 22 provided at the upper position of the case 12, and the switching lever 26 includes a switching knob 28 formed at an end portion of an arm member 27 formed into a trapezoidal shape so as to project upward, a revolving shaft 29 rotatably provided at a substantially center position, a contact strip member 30 configured to allow a switching contact strip 31 formed of a conductive metallic member which generates switching signals to be mounted on a side surface at a rear end portion thereof, and a spring 32 and a support seat 33 provided at the rear end portion.

The switching lever storage chamber 22 is formed with a revolving shaft engaging hole 23 and the revolving shaft 29 of the switching lever 26 is engages thereto, so that the switching lever 26 is rotatably stored therein. The switching knob 28 including the arm member 27 is positioned out of the case 12, and the contact strip member 30 having the switching contact strip 31 mounted thereon is arranged in the interior of the storage chamber 22.

A speed control unit 44 is coupled to a sliding shaft 41 of the sliding operation unit 15, and the speed control unit 44 includes a rotation control sliding element 42 and a switch sliding element 43 moved in conjunction with the sliding shaft 41, and the sliding circuit board 13 having contact elements 45, 46, 47, and 48 which comes into resilient contact with the rotation control sliding element 42 and the switch sliding element 43.

The conventional trigger switch having a configuration as described above has a structure in which the switching lever 26 is arranged with the revolving shaft 29 engaged with the revolving shaft engaging hole 23 of the switching lever storage chamber 22. However, since any protective measure for entry of water from the outside is not taken at all, there is a problem such that water enters from around the revolving shaft 29 of the switching lever in association with a switching operation of the switching lever, and the entered water is propagated to contact elements disposed on a sliding circuit board, thereby causing an erroneous operation.

There is another problem in the prior art such that the contact element of the sliding circuit board has a configuration in which electrodes or upper portions of the electrodes are coated with resister for allowing movable contact strips (rotation control sliding element, switch sliding element) to slide thereon, and hence the entry of water causes leak between the electrodes, which accelerates occurrence of corrosion, thereby causing the erroneous operation.

SUMMARY OF THE INVENTION

Accordingly, it is an object of the invention to provide a trigger switch having a switching lever configured to switch the direction of rotation of a motor between a normal rotation and a reverse rotation, in which entry of water which might occur in association with an switching operation is prevented, and leak between contact points is prevented even when water reaches contact elements on a sliding circuit board, whereby occurrence of corrosion is restrained to eliminate the possibility of erroneous operation.

In order to solve the above-described problems, according to an aspect of the invention, there is provided a trigger switch including: a switching operation unit configured to control the rotation of a motor between a normal rotation and a reverse rotation; a sliding operation unit configured to be coupled to a trigger lever, a case configured to store the switching operation unit and the sliding operation unit; a cover configured to dose an opening surface of the case, the switching operation unit being partly built into an upper position of the case, and including a switching contact strip formed of a conductive metallic member which generates switching signals on a side surface of a rear end portion thereof, and a switching lever having a revolving shaft rotatably provided at a substantially center position, the sliding operation unit being partly build into a lower position of the case, and including a speed control unit having a sliding element which is configured to move in association with the operation of the trigger lever, and a sliding shaft coupled at a rear end to the speed control unit and allows the trigger lever to be mounted on a distal end portion thereof, the cover including a sliding circuit board having contact elements on which the sliding element slides, wherein the case is formed with a speed control unit storage chamber configured to store the speed control unit, a revolving shaft storage chamber configured to store the revolving shaft of the switching lever, and a contact strip member storage chamber provided with continuing from the revolving shaft storage chamber through a shielding member therebetween and configured to store the contact strip member of the switching lever, the revolving shaft storage chamber is formed with a revolving shaft engaging hole configured to allow the revolving shaft to be inserted in an engaged state on an upper portion thereof on the side of the trigger lever, and a waterproof device configured to cover at least a gap between the switching lever and the revolving shaft engaging hole is provided to prevent entry of water therein.

Preferably, the waterproof device is a waterproof packing configured to fit so as to cover at least a portion including a periphery of a portion in the proximity of the revolving shaft of an arm member which forms a distal end side of the switching lever and a top surface of the revolving shaft storage chamber.

Preferably, the waterproof device is rubber-like resin filled between the switching lever and the top surface of the revolving shaft storage chamber in which the switching lever is built.

Preferably, the waterproof device is a waterproof packing configured to fit so as to cover a portion including a periphery of a portion in the proximity of the revolving shaft of an arm member which forms a distal end side of the switching lever, an upper lever guide member of a pair of upper and lower lever guides configured to guide the trigger lever provided on the case on the side of the trigger lever, a sliding shaft configured to be moved in conjunction with the trigger lever, and the entire top surface of the case.

Preferably, the waterproof device is a waterproof packing configured to fit so as to cover a portion including a periphery of a portion in the proximity of the revolving shaft of an arm member which forms a distal end side of the switching lever, a pair of upper and lower lever guides configured to guide the trigger lever provided on the case on the side of the trigger lever, the sliding shaft configured to be moved in conjunction with the trigger lever, and the entire top surface of the case.

Preferably, a drip-proof device is provided to prevent adhesion of water on the contact elements of the sliding circuit board. For example, the drip-proof device may be provision of a low-resistance resistance film on the contact elements. Also, the drip-proof device may be formation of slits between the contact elements.

According to the trigger switch in the invention, problems such as leak or erroneous operation are prevented by rendering waterproof around the revolving shaft of the normal and reverse switching lever which is most subjected to entry of water in terms of structure. In addition, entry of water from the outside is completely prevented by enlarging the range of waterproof to the sliding operation unit that is moved in conjunction with the trigger lever.

Further, occurrence of corrosion due to the leak between the contact points of the contact elements is restrained even when water is adhered on the contact elements by covering the contact elements disposed on the sliding circuit board with a low-resistance resister. Further, adhesion of water is restrained by forming the slits between the contact elements, so that the leak between the contact points is eliminated, and occurrence of the corrosion is restrained.

DETAILED DESCRIPTION OF THE PREFERRED EMBODIMENTS

Figure 1:
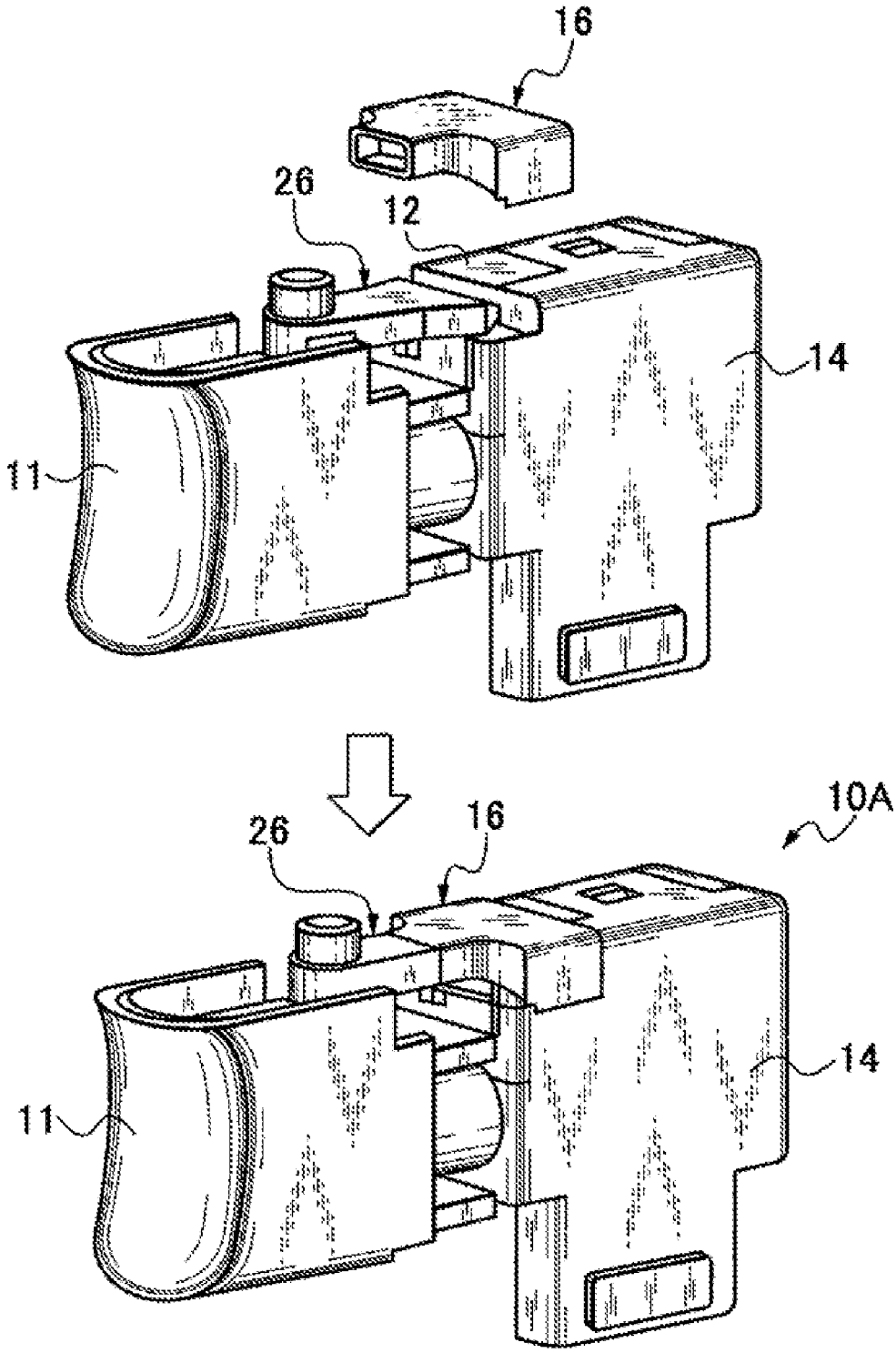
FIG. 1 is a perspective view showing a trigger switch according to a first embodiment of the invention.

FIGS. 1 to 4 show a trigger switch 10A according to a first embodiment of the invention, which is used as a power tool switch. The trigger switch 10A includes a sliding contact point mechanism (speed control unit 44) integrated in the interior of a main body formed into a box shape, a trigger lever 11 arranged outside and configured to allow a user to operate with his or her finger, a sliding operation unit 15 configured to transmit a sliding operation from the trigger lever 11, a case 12 opening on one of side surfaces, a cover 14 configured to cover the opening side surface and having a sliding circuit board 13 mounted on an inner side thereof, a switching operation unit 25 arranged at an upper position of the case 12 and configured to switch the direction of rotation of a motor between a normal rotation and a reverse rotation, an a waterproof packing 16 formed of rubber and mounted so as to cover an upper surface of the switching lever 26 of the switching operation unit 25 and a top surface of the case 12.

The sliding operation unit 15 is formed into a rod shape, and includes a sliding shaft 41 configured to allow the trigger lever 11 to be mounted on a distal end thereof, and the speed control unit 44 mounted on a proximal end side of the sliding shaft 41. The speed control unit 44 is configured to control a rotational speed of the motor in cooperation with the sliding circuit board 13, described later, and includes two sliding elements 42 and 43 arranged on the side surface in parallel to each other. An O-ring 38 and an external packing 39 are fitted on the sliding shaft 41, the distal end side of the sliding shaft 41 is coupled to the trigger lever 11, and an E-ring 59 is fitted thereon, so that the sliding shaft 41 does not come apart from the trigger lever 11.

Figure 2:
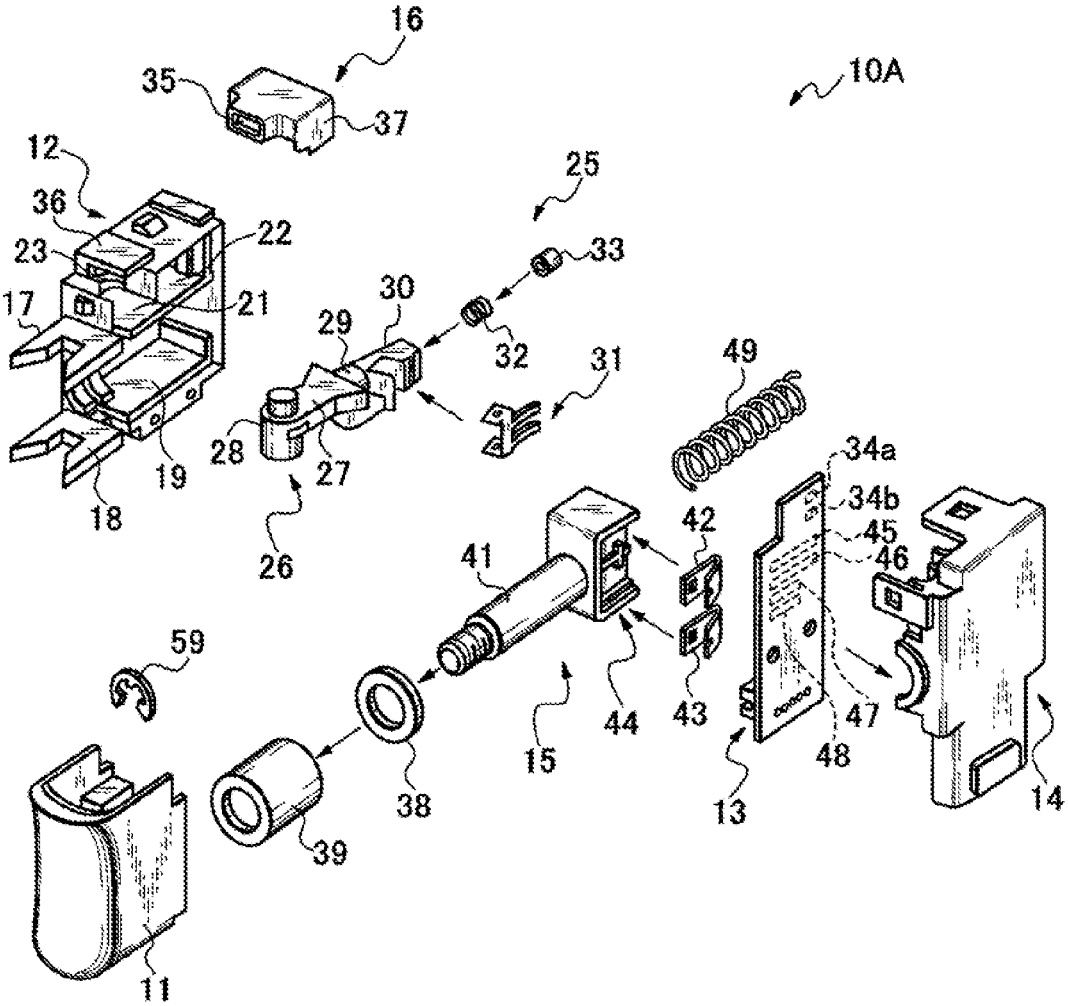
FIG. 2 is an exploded perspective view showing an internal structure of the trigger switch in FIG. 1.

As shown in FIG. 2, the switching lever 26 which constitutes the switching operation unit 25 includes a switching knob 28 formed at an end portion of an arm member 27 formed into a trapezoidal shape so as to project upward, a revolving shaft 29 rotatably provided at a substantially center position, a contact strip member 30 configured to allow a switching contact strip 31 formed of a conductive metallic member which generates switching signals to be mounted on a side surface at a rear end portion thereof, and a spring 32 and a support seat 33 provided at the rear end portion.

The case 12 is formed into a box shape opening on the side surface, and includes a pair of upper and lower lever guide members 17 and 18 configured to guide the trigger lever 11 on the side surfaces on the side of the trigger lever 11 as shown in FIG. 2. A speed control unit storage chamber 19 configured to store the speed control unit 44 which constitutes the sliding operation unit 15 is defined on the inner side between the lever guide members 17 and 18. Formed above the speed control unit storage chamber 19 is a revolving shaft storage chamber 21 configured to store the revolving shaft 29 of the switching lever 26 and a contact strip member storage chamber 22 provided with continuing from the revolving shaft storage chamber 21 through a shielding member therebetween and configured to store the contact strip member 30 of the switching lever 26. A revolving shaft engaging hole 23 is formed on an upper portion of the revolving shaft storage chamber 21 on the side of the trigger lever 11 configured to allow the revolving shaft 29 to be inserted in an engaged state.

The revolving shaft storage chamber 21 is a chamber configured to engage the revolving shaft 29 of the switching lever 26 into the revolving shaft engaging hole 23 as described above, and the arm member 27 formed at a level one step higher than the revolving shaft 29 and the switching lever 26 continued from an arm member are arranged outside the case 12.

Figure 3:
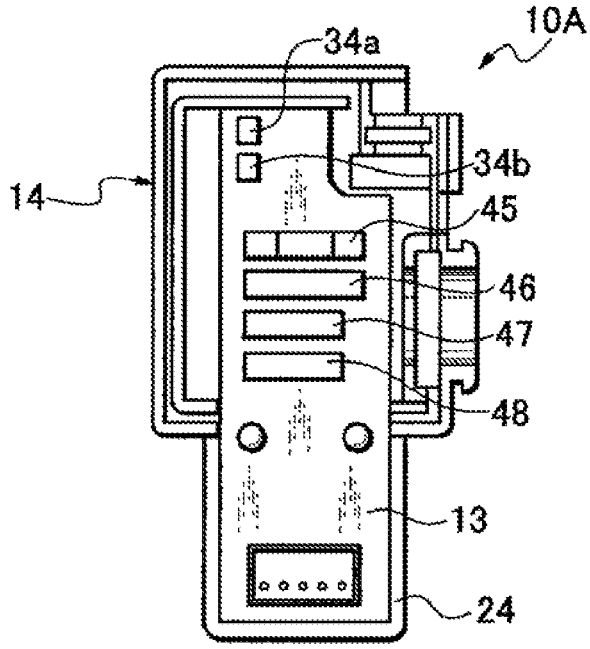
FIG. 3 is a plan view of a sliding circuit board mounted on a cover of the trigger switch in FIG. 1.

The cover 14 is configured to mount the rectangular sliding circuit board 13 on an substrate mounting portion 24 formed on an inner wall surface thereof, as shown in FIGS. 2 and 3. The sliding circuit board 13 includes switching contact elements 34*a* and 34*b*. The switching contact strip 31 is arranged in the contact strip member storage chamber 22 so as to oppose the switching contact elements 34*a* and 34*b*. Accordingly, the switching contact strip 31 comes into contact with the switching contact elements 34*a* and 34*b* in association of an operation of the switching knob 28 of the switching lever 26.

Figure 4:
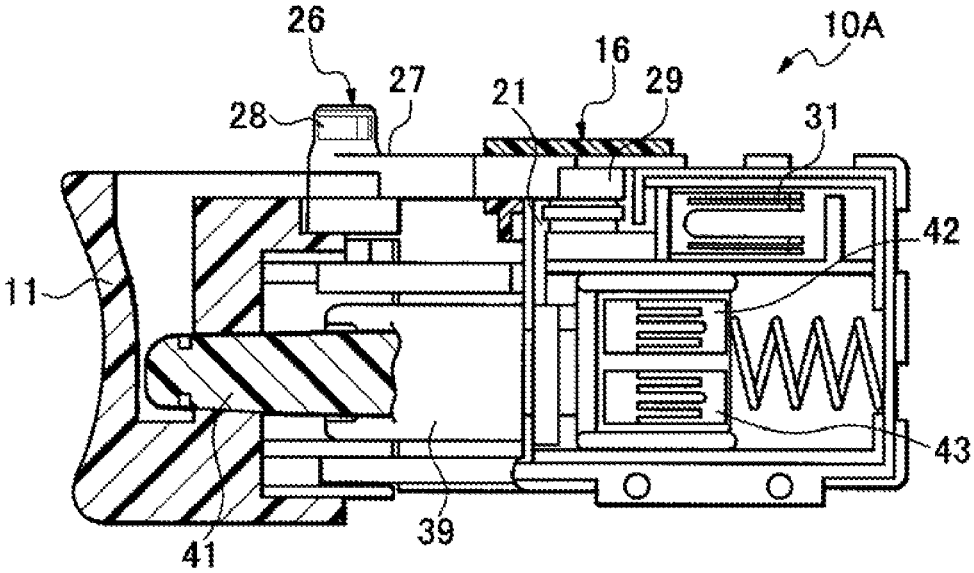
FIG. 4 is a partial cross-sectional view of the trigger switch in FIG. 1.

As shown in FIGS. 1, 2, and 4, the waterproof packing 16 is formed of rubber and includes a rectangular engaging portion 35 configured to allow penetration of the arm member 27 of the switching lever 26 exposed outside therethrough and cover the same, and a chamber waterproof member 37 opening on the lower side and having a size to cover a top surface 36 of the revolving shaft storage chamber 21.

The speed control unit 44 coupled to the sliding shaft 41 includes the rotation control sliding element 42 and the switch sliding element 43 interlocked with the sliding shaft 41, and the sliding circuit board 13 having contact elements 45, 46, 47, and 48 which come into resilient contact with the rotation control sliding element 42 and the switch sliding element 43.

The contact elements 45, 46, 47, and 48 disposed on the sliding circuit board 13 are arranged in parallel and in proper alignment. The variable contact element 45 is positioned on the top and constitutes a band-shaped resister. The sliding contact element 46 is formed of a conductive member in parallel with, and to have the same length as, the variable contact element 45. The control contact element 47 is formed of the conductive member in parallel with, and to have a shorter length than, the sliding contact element 46. The auxiliary contact element 48 is formed of the conductive member in parallel with, and to have the same length as, the control contact element 47.

The switching operation unit 25 configured as described above generates the switching signals by engaging the revolving shaft 29 of the switching lever 26 in the revolving shaft engaging hole 23 of the case 12, keeping the switching contact strip 31 in a state of opposing the switching contact elements 34*a* and 34*b* of the sliding circuit board 13, and bringing the switching contact elements 34*a* and 34*b* into a conducting state by the switching contact strip 31 in association with the operation of the switching knob 28.

Control of the rotation of the motor is achieved by bringing the rotation control sliding element 42 into abutment with the contact elements 45, 46, 47, and 48 disposed on the sliding circuit board 13 so that a brush comes into contact with both the sliding contact element 46 and the variable contact element 45, thereby changing the resister of the variable contact element 45. At the same time, abutment of the switch sliding element 43 so that the brush comes into contact with both the control contact element 47 and the auxiliary contact element 48 functions as an auxiliary switch.

The waterproof packing 16 is mounted by fitting the engaging portion 35 on the arm member of the switching lever 26 so as to penetrate therethrough, covering the periphery of the arm member exposed to the outside, and covering the top surface 36 which defines the revolving shaft storage chamber 21 of the case 12 with the chamber waterproof member 37 as specifically shown in FIGS. 2 and 4. By mounting the waterproof packing 16 in this manner, the arm member of the switching lever 26 is covered with the waterproof packing 16 when a switching operation is performed with the switching lever 26, and hence entry of water from a gap between the arm member and the top surface 36 of the case 12 can be prevented.

Figure 5:
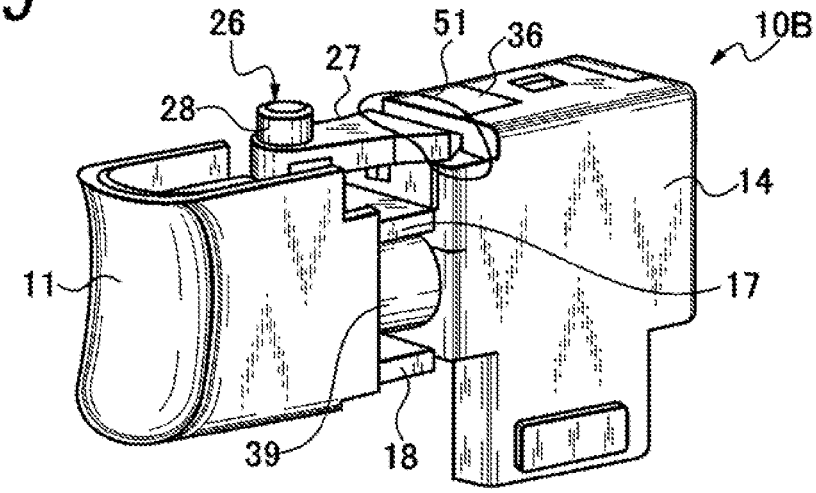
FIG. 5 is a perspective view showing the trigger switch according to a second embodiment of the invention.

FIG. 5 shows a trigger switch 10B according to a second embodiment of the invention, which is the same as the first embodiment except that a silicon-based adhesive agent 51 is filled in the gap between the arm member of the switching lever 26 and the top surface 36 on the side of the case 12 instead of the waterproof packing 16 in the first embodiment.

Figure 6:
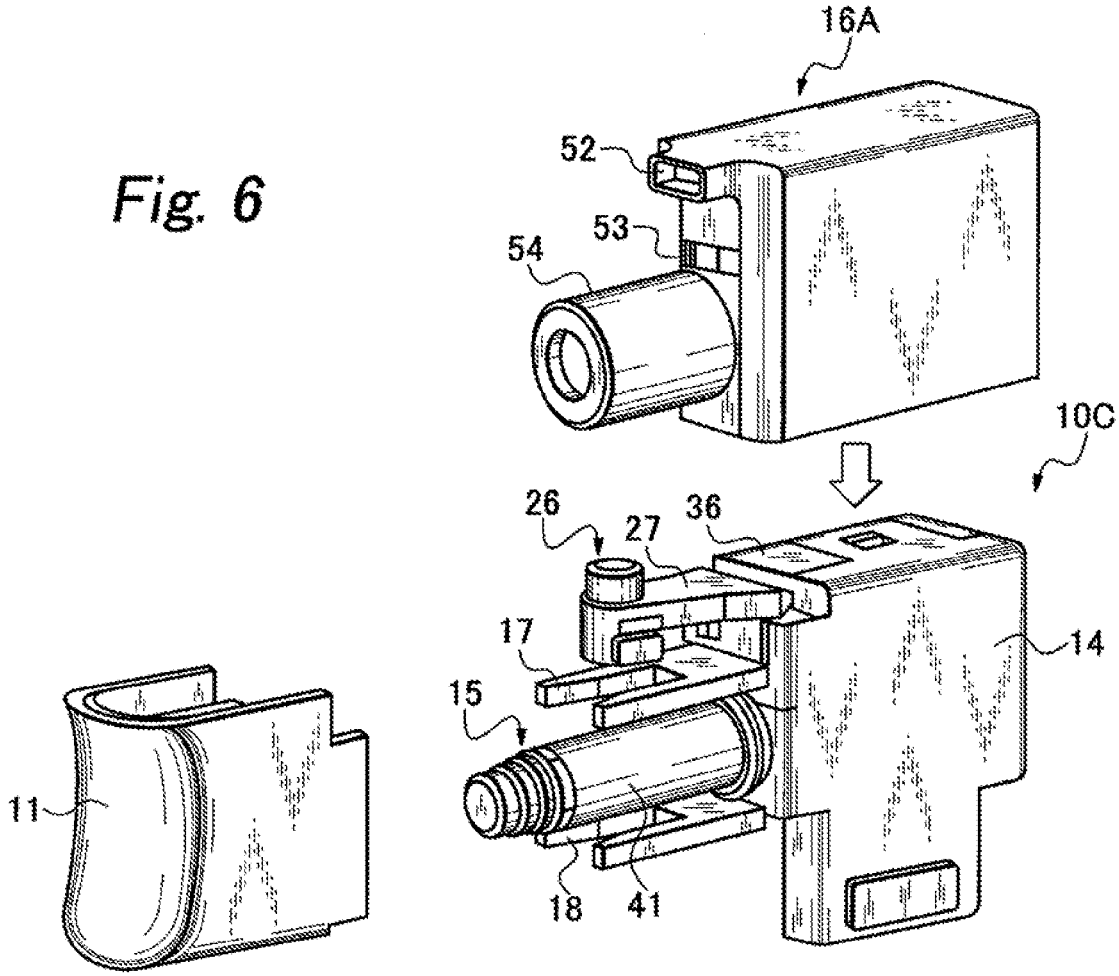
FIG. 6 is a perspective view of the trigger switch according to a third embodiment of the invention in a state before a trigger lever and a waterproof packing are mounted.
Figure 7:
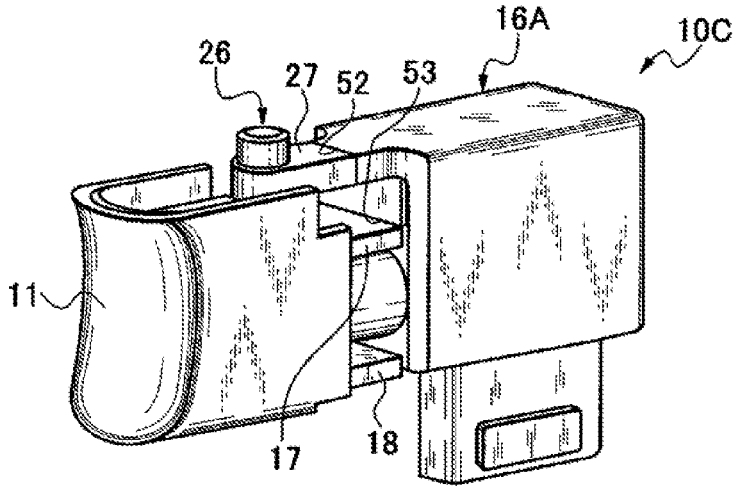
FIG. 7 is a perspective view of the trigger switch according to the third embodiment of the invention.

FIGS. 6 and 7 show a trigger switch 10C according to a third embodiment, which employs a waterproof packing 16A which prevent the entry of water not only from the portion of the switching lever 26, but also from the portion of the sliding operation unit 15 which is slid by the operation of the trigger lever 11. In other words, the waterproof packing 16A is formed integrally with a lever engaging portion 52 configured to allow penetration of the arm member of the switching lever 26 therethrough and cover the same, a guide engaging portion 53 configured to allow penetration of the upper lever guide member 17 therethrough and cover the same, and a sliding operation packing 54 configured to allow penetration of the sliding shaft 41 therethrough and serve also as an external packing. With the waterproof packing 16A, as shown in FIG. 7, since the substantially entire parts of the cover 14 and the case 12 are covered, a joint portion between the case 12 and the cover 14 is covered in addition to the prevention of entry of water from moving portions, so that the prevention of entry of water is achieved substantially completely.

Figure 8:
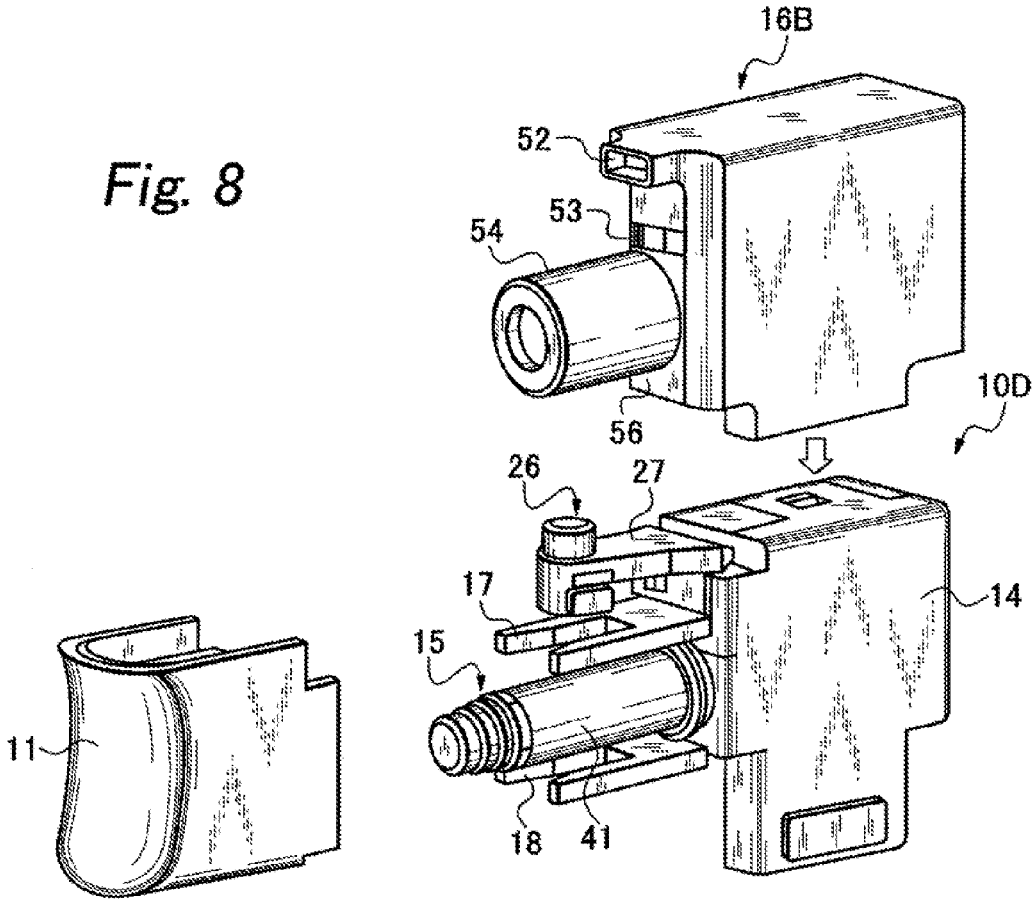
FIG. 8 is a perspective view of the trigger switch according to a fourth embodiment of the invention in a state before the trigger lever and the waterproof packing are mounted.
Figure 9:
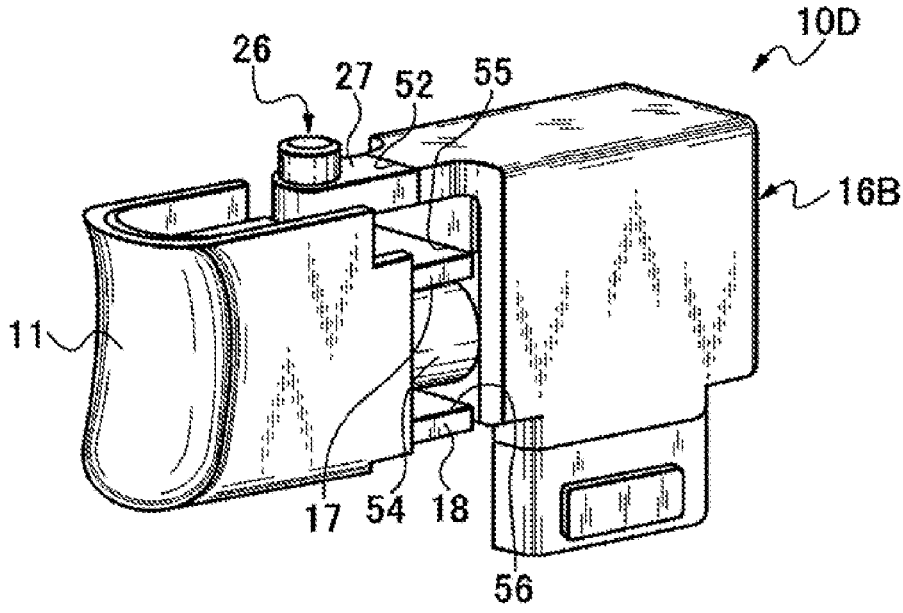
FIG. 9 is a perspective view of the trigger switch according to the fourth embodiment of the invention.

FIGS. 8 and 9 show a trigger switch 10D according to a fourth embodiment, which is the same as the third embodiment except that a waterproof packing 16B having a lower guide engaging portion 56 configured to allow penetration of the lower lever guide member 18 and cover the same is provided. In other words, the waterproof packing 16B achieves the prevention of entry of water substantially completely in the form of covering the lower lever guide member 18 that is not covered by the waterproof packing 16A.

Figure 10:
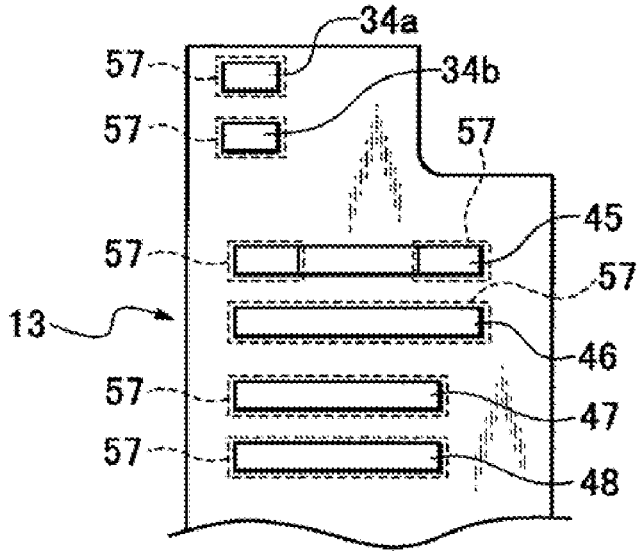
FIG. 10 is a plan view showing a substrate of the trigger switch according to a fifth embodiment of the invention.

FIG. 10 shows the sliding circuit board 13 in a trigger switch according to a fifth embodiment. The contact elements 45, 46, 47, and 48 provided on the sliding circuit board 13 are coated with a low-resistance resistance film 57, for example, a film of the conductive member formed of carbon. In this configuration, adhesion of incoming water is prevented and phenomena occurring in association with the adhesion of water such as electrolysis are restrained.

Figure 11:
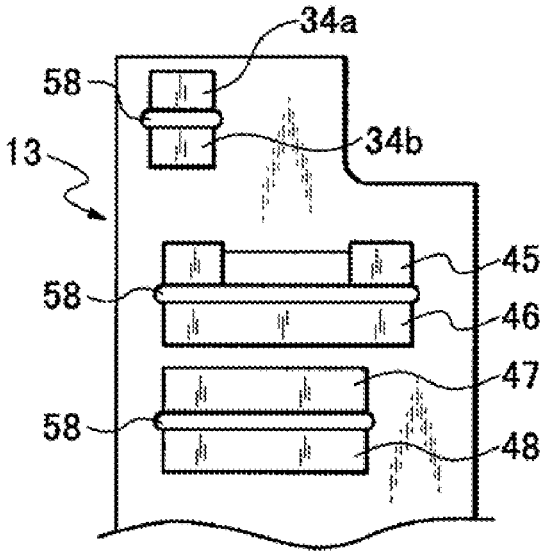
FIG. 11 is a plan view showing the substrate of the trigger switch according to a sixth embodiment of the invention.
Figure 12:
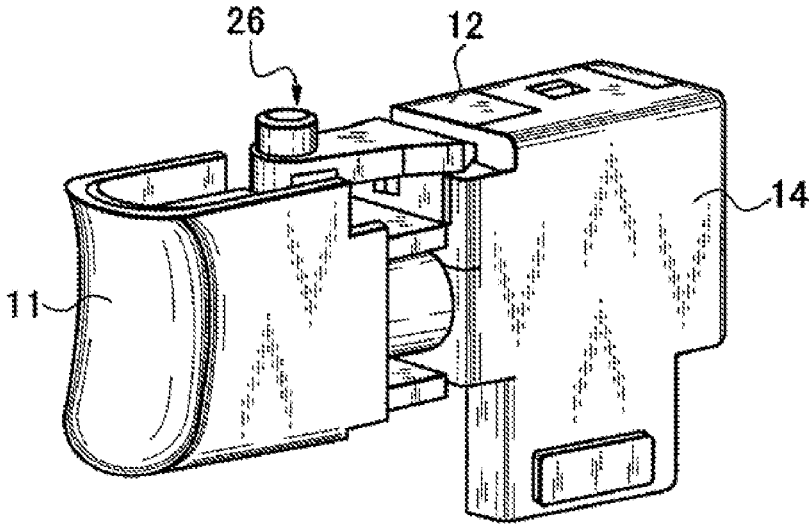
Fig. 12 PRIOR ART
FIG. 12 is a perspective view showing a trigger switch in the prior art.
Figure 13:
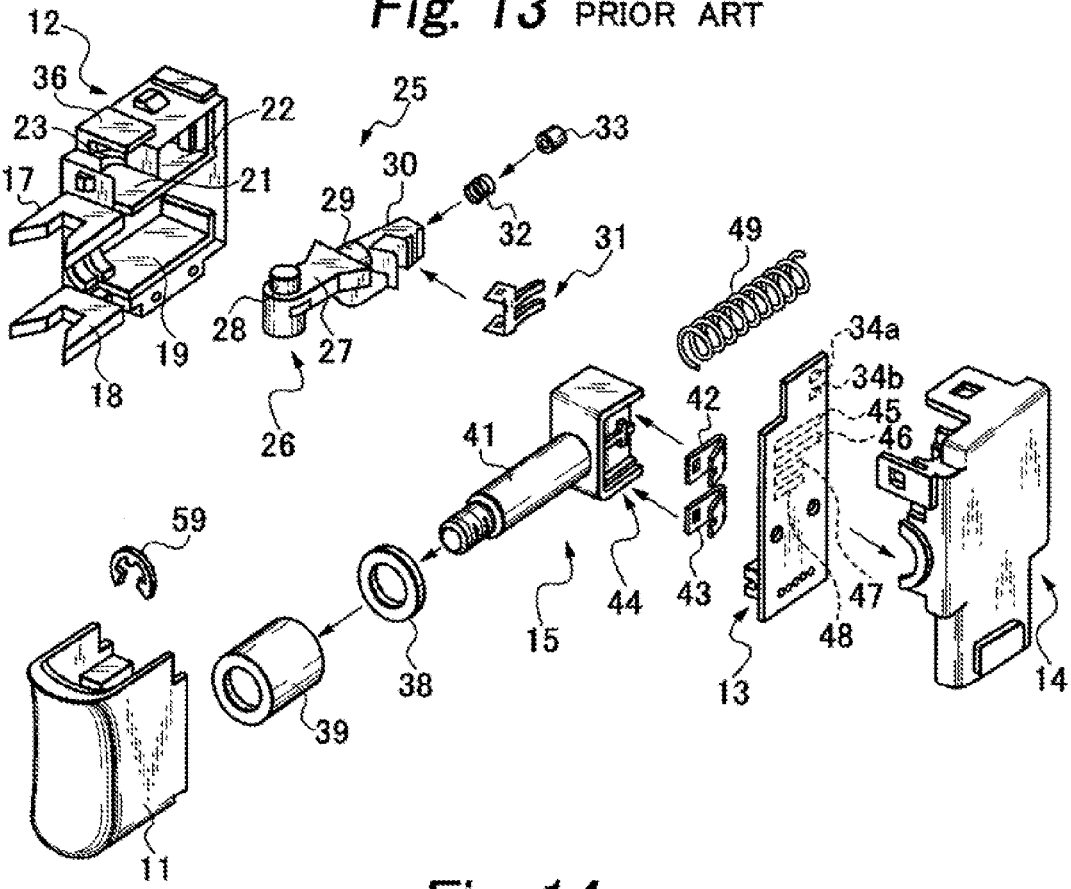
Fig. 13 PRIOR ART
FIG. 13 is an exploded perspective view showing an internal structure of the trigger switch in the prior art.
Figure 14:
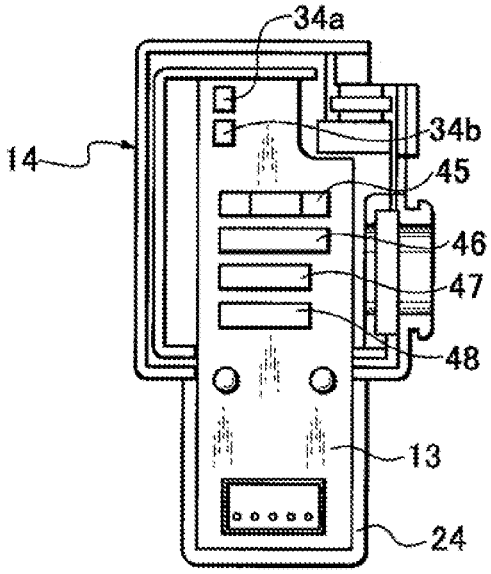
Fig. 14 PRIOR ART
FIG. 14 is a plan view showing a sliding circuit board mounted on a cover of the trigger switch in the prior art.

FIG. 11 shows the sliding circuit board 13 in the trigger switch according to a sixth embodiment. The sliding circuit board 13 in the sixth embodiment is formed with slits 58 between the switching contact elements 34*a* and 34*b*, between the contact elements 45 and 46, and between the contact elements 47 and 48, respectively. In this configuration, since incoming water does not reach the contact elements, the phenomenon such as the electrolysis is restrained. Consequently, leak and the like are eliminated and occurrence of corrosion is restrained, and an erroneous operation is avoided.

The trigger switch of the invention is available as the power tool switch because the leak between the contact points or the erroneous operation due to the entry of water is prevented.

What is claimed is:

1. A trigger switch comprising:

a switching operation unit configured to control the rotation of a motor between a normal rotation and a reverse rotation;

a sliding operation unit configured to be coupled to a trigger lever, a case configured to store the switching operation unit and the sliding operation unit;

a cover configured to close an opening surface of the case, the switching operation unit being partly built into an upper position of the case, and including a switching contact strip formed of a conductive metallic member which generates switching signals on a side surface of a rear end portion thereof, and a switching lever having a revolving shaft rotatably provided at a substantially center position, the sliding operation unit being partly build into a lower position of the case, and including a speed control unit having sliding elements which is configured to move in association with the operation of the trigger lever, and a sliding shaft coupled at a rear end to the speed control unit and allows the trigger lever to be mounted on a distal end portion thereof, the cover including a sliding circuit board having contact elements on which the sliding elements slide, wherein the case is formed with a speed control unit storage chamber configured to store the speed control unit, a revolving shaft storage chamber configured to store the revolving shaft of the switching lever, and a contact strip member storage chamber provided with continuing from the revolving shaft storage chamber through a shielding member therebetween and configured to store the contact strip member of the switching lever, the revolving shaft storage chamber is formed with a revolving shaft engaging hole configured to allow the revolving shaft to be inserted in an engaged state on an upper portion thereof on the side of the trigger lever, and a waterproof device configured to cover at least a gap between the switching lever and the revolving shaft engaging hole is provided to prevent entry of water therein.

2. The trigger switch according to claim 1, wherein the waterproof device is a waterproof packing configured to fit so as to cover at least a portion including a periphery of a portion in the proximity of the revolving shaft of an arm member which forms a distal end side of the switching lever and a top surface of the revolving shaft storage chamber.

3. The trigger switch according to claim 1, wherein the waterproof device is rubber-like resin filled between the switching lever and the top surface of the revolving shaft storage chamber in which the switching lever is built.

4. The trigger switch according to claim 1, wherein the waterproof device is a waterproof packing configured to fit so as to cover a portion including a periphery of a portion in the proximity of the revolving shaft of an arm member which forms a distal end side of the switching lever, an upper lever guide member of a pair of upper and lower lever guides configured to guide the trigger lever provided on the case on the side of the trigger lever, a sliding shaft configured to be moved in conjunction with the trigger lever, and the entire top surface of the case.

5. The trigger switch according to claim 1, wherein the waterproof device is a waterproof packing configured to fit so as to cover a portion including a periphery of a portion in the proximity of the revolving shaft of an arm member which forms a distal end side of the switching lever, a pair of upper and lower lever guides configured to guide the trigger lever provided on the case on the side of the trigger lever, the sliding shaft configured to be moved in conjunction with the trigger lever, and the entire top surface of the case.

6. A trigger switch comprising:

a switching operation unit configured to control the rotation of a motor between a normal rotation and a reverse rotation;

a sliding operation unit configured to be coupled to a trigger lever, a case configured to store the switching operation unit and the sliding operation unit;

a cover configured to close an opening surface of the case, the switching operation unit is partly built into an upper position of the case, and includes a switching contact strip formed of a conductive metallic member which generates switching signals on a side surface of a rear end portion thereof, and a switching lever having a revolving shaft rotatably provided at a substantially center position, the sliding operation unit is partly build into a lower position of the case, and includes a speed control unit having a sliding element which is configured to move in association with the operation of the trigger lever, and a sliding shaft coupled at a rear end to the speed control unit and allows the trigger lever to be mounted on a distal end portion thereof, the cover includes a sliding circuit board having contact elements on which the sliding element slides, wherein a drip-proof device is provided to prevent adhesion of water on the contact elements of the sliding circuit board.

7. The trigger switch according to claim 6, wherein the drip-proof device is provision of a low-resistance resistance film on the contact elements.

8. The trigger switch according to claim 6, wherein the drip-proof device is formation of slits between the contact elements.

* * * * *